US010873996B2

(12) United States Patent
Carcano et al.

(10) Patent No.: US 10,873,996 B2
(45) Date of Patent: Dec. 22, 2020

(54) OVEN DOOR ASSEMBLY FOR AN RF OVEN

(71) Applicant: ILLINOIS TOOL WORKS INC., Glenview, IL (US)

(72) Inventors: Marco Carcano, Senago (IT); Michele Gentile, Jesi (IT); Michele Sclocchi, San Donato Milanese (IT)

(73) Assignee: ILLINOIS TOOL WORKS, INC., Glenview, IL (US)

( * ) Notice: Subject to any disclaimer, the term of this patent is extended or adjusted under 35 U.S.C. 154(b) by 362 days.

(21) Appl. No.: 15/809,324

(22) Filed: Nov. 10, 2017

(65) Prior Publication Data

US 2018/0153003 A1 May 31, 2018

Related U.S. Application Data

(60) Provisional application No. 62/427,960, filed on Nov. 30, 2016.

(51) Int. Cl.

| | |
|---|---|
| ***H05B 6/76*** | (2006.01) |
| ***F24C 15/02*** | (2006.01) |
| ***H05B 6/64*** | (2006.01) |

(52) U.S. Cl.

CPC ..... *H05B 6/763* (2013.01); *F24C 15/024* (2013.01); *H05B 6/6414* (2013.01)

(58) Field of Classification Search

CPC .... H05B 6/763; H05B 6/6417; H05B 6/6414; H05B 6/64; H05B 6/66; H05B 6/68; F24C 15/022; F24C 15/024; F24C 14/02; F24C 15/02; F24C 15/20; F24C 15/32

USPC ..... 219/741, 413, 744, 724, 396

See application file for complete search history.

(56) References Cited

U.S. PATENT DOCUMENTS 3,215,816 A * 11/1965 Perl ..... F24C 15/006 219/400
3,350,542 A 10/1967 Getman
3,353,004 A * 11/1967 Alexander ..... H05B 1/0225 219/398

(Continued)

FOREIGN PATENT DOCUMENTS

DE 8900624 U1 3/1989
FR 2265042 A1 10/1975

OTHER PUBLICATIONS

International Search Report and Written Opinion of PCT/US2017/061923 dated Feb. 28, 2018, all enclosed pages cited.

*Primary Examiner* — Charles Cheyney
(74) *Attorney, Agent, or Firm* — Burr & Forman, LLP

(57) ABSTRACT

An oven may include a door movable between an open position and a closed position, a cooking chamber configured to receive a food product, an RF energy source and an RF choke. The cooking chamber may be defined at least in part by a top wall, a bottom wall, a first sidewall and a second sidewall, and may define an opening that interfaces with the door. The RF energy source may be configured to apply RF energy to the food product. The RF choke may be disposed at a portion of the door facing the cooking chamber when the door is in the closed position. The door may include a handle disposed on a side of the door opposite the RF choke. The handle may be attached to a front face of the door at an angle relative to the front face of the door such that the handle extends beyond a top of the door along a direction extending from a pivot axis of the door toward the top of the door.

19 Claims, 8 Drawing Sheets

(56) References Cited

U.S. PATENT DOCUMENTS

| | | | | | |
|---|---|---|---|---|---|
| 3,569,670 | A | * | 3/1971 | Eff | F24C 14/02 219/413 |
| 3,629,537 | A | * | 12/1971 | Haagensen | H05B 6/763 219/741 |
| 3,659,068 | A | * | 4/1972 | Duffner | H05B 6/6417 219/724 |
| 3,715,554 | A | * | 2/1973 | Umezu | H05B 6/6417 219/724 |
| 3,794,797 | A | * | 2/1974 | Nakano | F24C 7/02 219/741 |
| 3,828,163 | A | * | 8/1974 | Amagami | F24C 7/00 219/413 |
| 3,943,319 | A | | 3/1976 | Hirai et al. | |
| 3,991,295 | A | | 11/1976 | Akiyoshi | |
| 4,013,861 | A | * | 3/1977 | Westfall | H05B 6/763 219/741 |
| 4,471,194 | A | * | 9/1984 | Hosokawa | H05B 6/763 219/699 |
| 4,547,642 | A | * | 10/1985 | Smith | F24C 14/00 126/21 A |
| 6,672,867 | B1 | * | 1/2004 | Du | F24C 7/082 126/198 |
| D589,777 | S | * | 4/2009 | Brockington | D8/316 |

* cited by examiner

OVEN DOOR ASSEMBLY FOR AN RF OVEN

CROSS REFERENCE TO RELATED APPLICATIONS

This application claims priority to U.S. application No. 62/427,960 filed Nov. 30, 2016, the entire contents of which are hereby incorporated by reference in its entirety.

TECHNICAL FIELD

Example embodiments generally relate to ovens and, more particularly, relate to an oven that uses radio frequency (RF) heating along with convection heating and an oven door for use with the same.

BACKGROUND

Combination ovens that are capable of cooking using more than one heating source (e.g., convection, steam, microwave, etc.) have been in use for decades. Each cooking source comes with its own distinct set of characteristics. Thus, a combination oven can typically leverage the advantages of each different cooking source to attempt to provide a cooking process that is improved in terms of time and/or quality.

In some cases, microwave cooking may be faster than convection or other types of cooking. Thus, microwave cooking may be employed to speed up the cooking process. However, a microwave typically cannot be used to cook some foods and also cannot brown foods. Given that browning may add certain desirable characteristics in relation to taste and appearance, it may be necessary to employ another cooking method in addition to microwave cooking in order to achieve browning. In some cases, the application of heat for purposes of browning may involve the use of heated airflow provided within the oven cavity to deliver heat to a surface of the food product.

However, even by employing a combination of microwave and airflow, the limitations of conventional microwave cooking relative to penetration of the food product may still render the combination less than ideal. Moreover, a typical microwave is somewhat indiscriminate or uncontrollable in the way it applies energy to the food product. Thus, it may be desirable to provide further improvements to the ability of an operator to achieve a superior cooking result. However, providing an oven with improved capabilities relative to cooking food with a combination of controllable RF energy and convection energy may require the structures and operations of the oven to be substantially redesigned or reconsidered.

BRIEF SUMMARY OF SOME EXAMPLES

Some example embodiments may therefore provide improved structures and/or systems for providing access to the oven.

In an example embodiment, an oven is provided. The oven may include a door movable between an open position and a closed position, a cooking chamber configured to receive a food product, an RF energy source and an RF choke. The cooking chamber may be defined at least in part by a top wall, a bottom wall, a first sidewall and a second sidewall, and may define an opening that interfaces with the door. The RF energy source may be configured to apply RF energy to the food product. The RF choke may be disposed at a portion of the door facing the cooking chamber when the door is in the closed position. The door may include a handle disposed on a side of the door opposite the RF choke. The handle may be attached to a front face of the door at an angle relative to the front face of the door such that the handle extends beyond a top of the door along a direction extending from a pivot axis of the door toward the top of the door.

In an example embodiment, an door assembly for an oven is provided. The door assembly may include a door, an RF choke, and a handle. The door may be movable between an open position and a closed position to interface with an opening defined in a cooking chamber of the oven. The cooking chamber may be defined at least in part by a top wall, a bottom wall, a first sidewall and a second sidewall. The RF choke may be disposed at a portion of the door facing the cooking chamber when the door is in the closed position. The handle may be disposed on a side of the door opposite the RF choke. The handle may be attached to a front face of the door at an angle relative to the front face of the door such that the handle extends beyond a top of the door along a direction extending from a pivot axis of the door toward the top of the door.

Some example embodiments may improve the operator experience when cooking with an oven employing an example embodiment.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
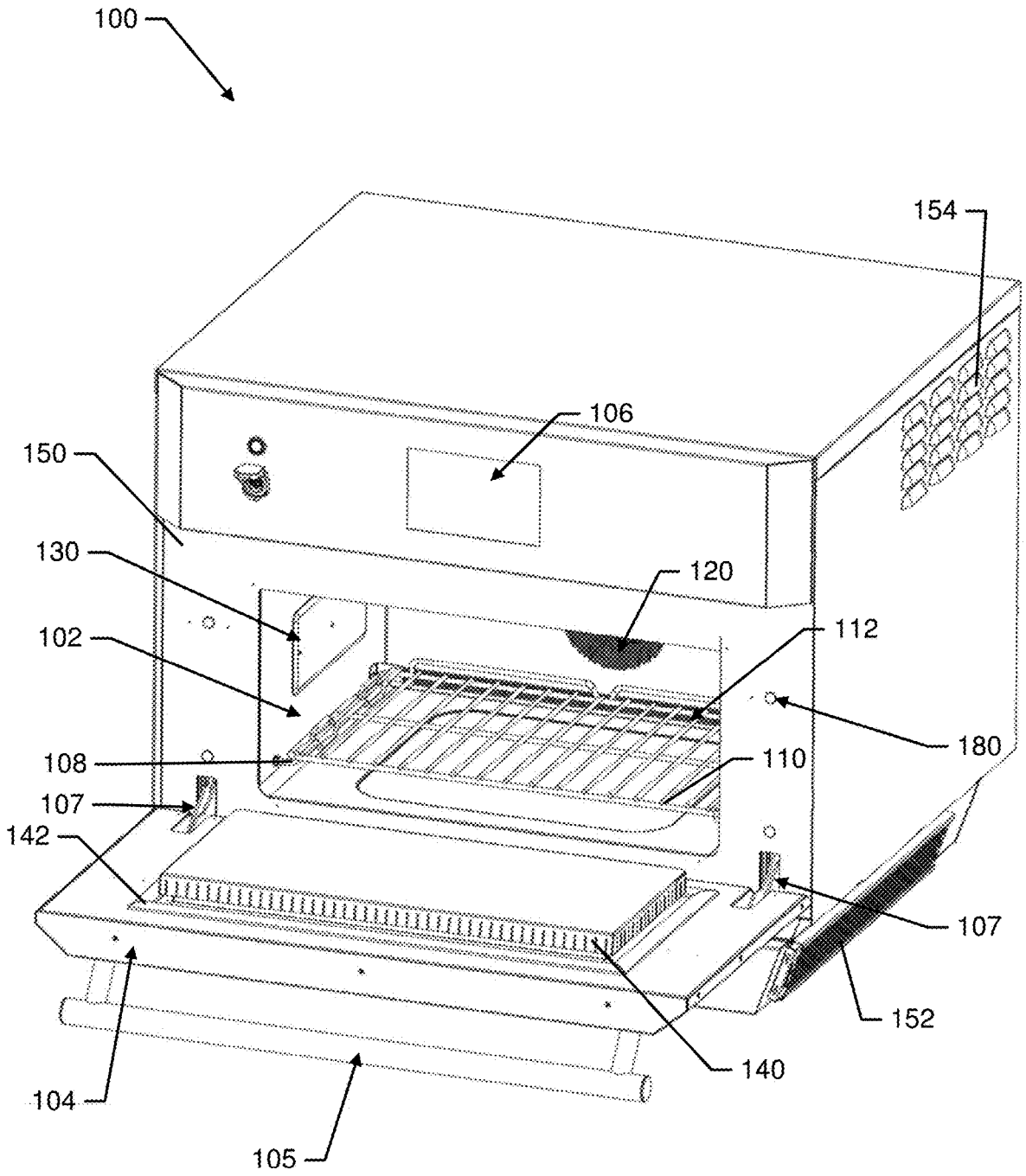
FIG. 1 illustrates a perspective view of an oven capable of employing at least two energy sources according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

Some example embodiments may improve the cooking performance of an oven and/or may improve the operator experience of individuals employing an example embodiment. In this regard, the oven may cook food relatively quickly, based on the application of controllable RF energy, and also enable the food to be browned by providing hot air into the oven with a convection system as described herein. However, in order to increase cooking speed using RF energy, prevention of RF leakage becomes an important consideration. Thus, an RF choke must be placed on the inside of the door. This may significantly add to the weight of the door. Having a relatively heavy door may render the pivoting of the door about a vertically oriented axis to be impractical. Thus, it is more likely that the weight of the door can be supported efficiently and safely by rotation about a horizontally oriented pivot axis.

Meanwhile, the cleanability and usability of the oven also remain key components to providing a quality product. Accordingly, some example embodiments may provide that the choke that sits on the inside of the oven door and (particularly the base portion of the choke) can actually be used as a surface upon which to rest pans or containers while the door is open. Such a door structure can also prevent the falling of such pans or containers to the ground if control of them is lost during insertion into or extraction from the oven. The base portion also provides a relatively easy to clean surface that is robust enough to support food product and withstand impact. However, for conventional door handles that extend perpendicularly to the front of the oven, sight of handle may be lost when the door is rotated to the open position. Moreover, it may be difficult to support the door as it reaches the fully open position, and thus, the user may otherwise tend to release the door over the last few degrees of rotation. In light of the weight of the door, the release of the door could cause the door to strike the user or spill product. To address these and other issues, various door design improvements may be provided. For example, a handle may be provided for the door such that the handle is visible and easily graspable by the user over the entire range of motion of the door. Other features to improve the cleanability and usability of the door may also be provided.

FIG. 1 illustrates a perspective view of an oven 1 according to an example embodiment. As shown in FIG. 1, the oven 100 may include a cooking chamber 102 into which a food product may be placed for the application of heat by any of at least two energy sources that may be employed by the oven 100. The cooking chamber 102 may include a door 104 and an interface panel 106, which may sit proximate to the door 104 when the door 104 is closed. The door 104 may be operable via handle 105, which may extend across the front of the oven 100 parallel to the surface upon which the oven is supported. In some cases, the interface panel 106 may be located substantially above the door 104 (as shown in FIG. 1) or alongside the door 104 in alternative embodiments. In an example embodiment, the interface panel 106 may include a touch screen display capable of providing visual indications to an operator and further capable of receiving touch inputs from the operator. The interface panel 106 may be the mechanism by which instructions are provided to the operator, and the mechanism by which feedback is provided to the operator regarding cooking process status, options and/or the like. The door 104 may rotate between an open position (shown in FIG. 1) and a closed position via a hinge assembly 107.

In some embodiments, the oven 100 may include multiple racks or may include rack (or pan) supports 108 or guide slots in order to facilitate the insertion of one or more racks 110 or pans holding food product that is to be cooked. In an example embodiment, air delivery orifices 112 may be positioned proximate to the rack supports 108 (e.g., just below a level of the rack supports in one embodiment) to enable heated air to be forced into the cooking chamber 102 via a heated-air circulation fan (not shown in FIG. 1). The heated-air circulation fan may draw air in from the cooking chamber 102 via a chamber outlet port 120 disposed at a rear wall (i.e., a wall opposite the door 104) of the cooking chamber 102. Air may be circulated from the chamber outlet port 120 back into the cooking chamber 102 via the air delivery orifices 112. After removal from the cooking chamber 102 via the chamber outlet port 120, air may be cleaned, heated, and pushed through the system by other components prior to return of the clean, hot and speed controlled air back into the cooking chamber 102. This air circulation system, which includes the chamber outlet port 120, the air delivery orifices 112, the heated-air circulation fan, cleaning components, and all ducting therebetween, may form a first air circulation system within the oven 100.

In an example embodiment, food product placed on a pan or one of the racks 110 (or simply on a base of the cooking chamber 102 in embodiments where racks 110 are not employed) may be heated at least partially using radio frequency (RF) energy. Meanwhile, the airflow that may be provided may be heated to enable further heating or even browning to be accomplished. Of note, a metallic pan may be placed on one of the rack supports 108 or racks 110 of some example embodiments. However, the oven 100 may be configured to employ frequencies and/or mitigation strategies for detecting and/or preventing any arcing that might otherwise be generated by using RF energy with metallic components.

In an example embodiment, the RF energy may be delivered to the cooking chamber 102 via an antenna assembly 130 disposed proximate to the cooking chamber 102. In some embodiments, multiple components may be provided in the antenna assembly 130, and the components may be placed on opposing sides of the cooking chamber 102. The antenna assembly 130 may include one or more instances of a power amplifier, a launcher, waveguide and/or the like that are configured to couple RF energy into the cooking chamber 102.

The cooking chamber 102 may be configured to provide RF shielding on five sides thereof (e.g., the top, bottom, back, and right and left sides), but the door 104 may include a choke 140 to provide RF shielding for the front side. The choke 140 may therefore be configured to fit closely with the opening defined at the front side of the cooking chamber 102 to prevent leakage of RF energy out of the cooking chamber 102 when the door 104 is shut and RF energy is being applied into the cooking chamber 102 via the antenna assembly 130.

In an example embodiment, a gasket 142 may be provided to extend around the periphery of the choke 140. In this regard, the gasket 142 may be formed from a material such as wire mesh, rubber, silicon, or other such materials that may be somewhat compressible between the door 104 and a periphery of the opening into the cooking chamber 102. The gasket 142 may, in some cases, provide a substantially air tight seal. However, in other cases (e.g., where the wire mesh is employed), the gasket 142 may allow air to pass therethrough. Particularly in cases where the gasket 142 is substantially air tight, it may be desirable to provide an air cleaning system in connection with the first air circulation system described above.

The antenna assembly 130 may be configured to generate controllable RF emissions into the cooking chamber 102 using solid state components. Thus, the oven 100 may not employ any magnetrons, but instead use only solid state components for the generation and control of the RF energy applied into the cooking chamber 102. The use of solid state components may provide distinct advantages in terms of allowing the characteristics (e.g., power/energy level, phase and frequency) of the RF energy to be controlled to a greater degree than is possible using magnetrons. However, since relatively high powers are necessary to cook food, the solid state components themselves will also generate relatively high amounts of heat, which must be removed efficiently in order to keep the solid state components cool and avoid damage thereto. To cool the solid state components, the oven 100 may include a second air circulation system.

The second air circulation system may operate within an oven body 150 of the oven 100 to circulate cooling air for preventing overheating of the solid state components that power and control the application of RF energy to the cooking chamber 102. The second air circulation system may include an inlet array 152 that is formed at a bottom (or basement) portion of the oven body 150. In particular, the basement region of the oven body 150 may be a substantially hollow cavity within the oven body 150 that is disposed below the cooking chamber 102. The inlet array 152 may include multiple inlet ports that are disposed on each opposing side of the oven body 150 (e.g., right and left sides when viewing the oven 100 from the front) proximate to the basement, and also on the front of the oven body 150 proximate to the basement. Portions of the inlet array 152 that are disposed on the sides of the oven body 150 may be formed at an angle relative to the majority portion of the oven body 150 on each respective side. In this regard, the portions of the inlet array 152 that are disposed on the sides of the oven body 150 may be tapered toward each other at an angle of about twenty degrees (e.g., between ten degrees and thirty degrees). This tapering may ensure that even when the oven 100 is inserted into a space that is sized precisely wide enough to accommodate the oven body 150 (e.g., due to walls or other equipment being adjacent to the sides of the oven body 150), a space is formed proximate to the basement to permit entry of air into the inlet array 152. At the front portion of the oven body 150 proximate to the basement, the corresponding portion of the inlet array 152 may lie in the same plane as (or at least in a parallel plane to) the front of the oven 100 when the door 104 is closed. No such tapering is required to provide a passage for air entry into the inlet array 152 in the front portion of the oven body 150 since this region must remain clear to permit opening of the door 104.

From the basement, ducting may provide a path for air that enters the basement through the inlet array 152 to move upward (under influence from a cool-air circulating fan) through the oven body 150 to an attic portion inside which control electronics (e.g., the solid state components) are located. The attic portion may include various structures for ensuring that the air passing from the basement to the attic and ultimately out of the oven body 150 via outlet louvers 154 is passed proximate to the control electronics to remove heat from the control electronics. Hot air (i.e., air that has removed heat from the control electronics) is then expelled from the outlet louvers 154. In some embodiments, outlet louvers 154 may be provided at right and left sides of the oven body 150 and at the rear of the oven body 150 proximate to the attic. Placement of the inlet array 152 at the basement and the outlet louvers 154 at the attic ensures that the normal tendency of hotter air to rise will prevent recirculation of expelled air (from the outlet louvers 154) back through the system by being drawn into the inlet array 152. As such, air drawn into the inlet array 152 can reliably be expected to be air at ambient room temperature, and not recycled, expelled cooling air.

In some embodiments, one or more sensors 180 may be provided to detect a position of the door 104. The sensors 180 may be Hall effect sensors configured to detect the door 104 in proximity thereto, may be plungers that are physically deflected when the door 104 is closed, or may be any other suitable sensing devices. In some cases, at least three sensors 180 may be provided as inputs to respective switches or other such components. In such an example, one switch may provide a cutoff signal to shut off application of RF any time the door is open. A second such switch may be provided as a backup. Another switch may provide an input to circuitry associated with the user interface of the oven 100.

Figure 2:
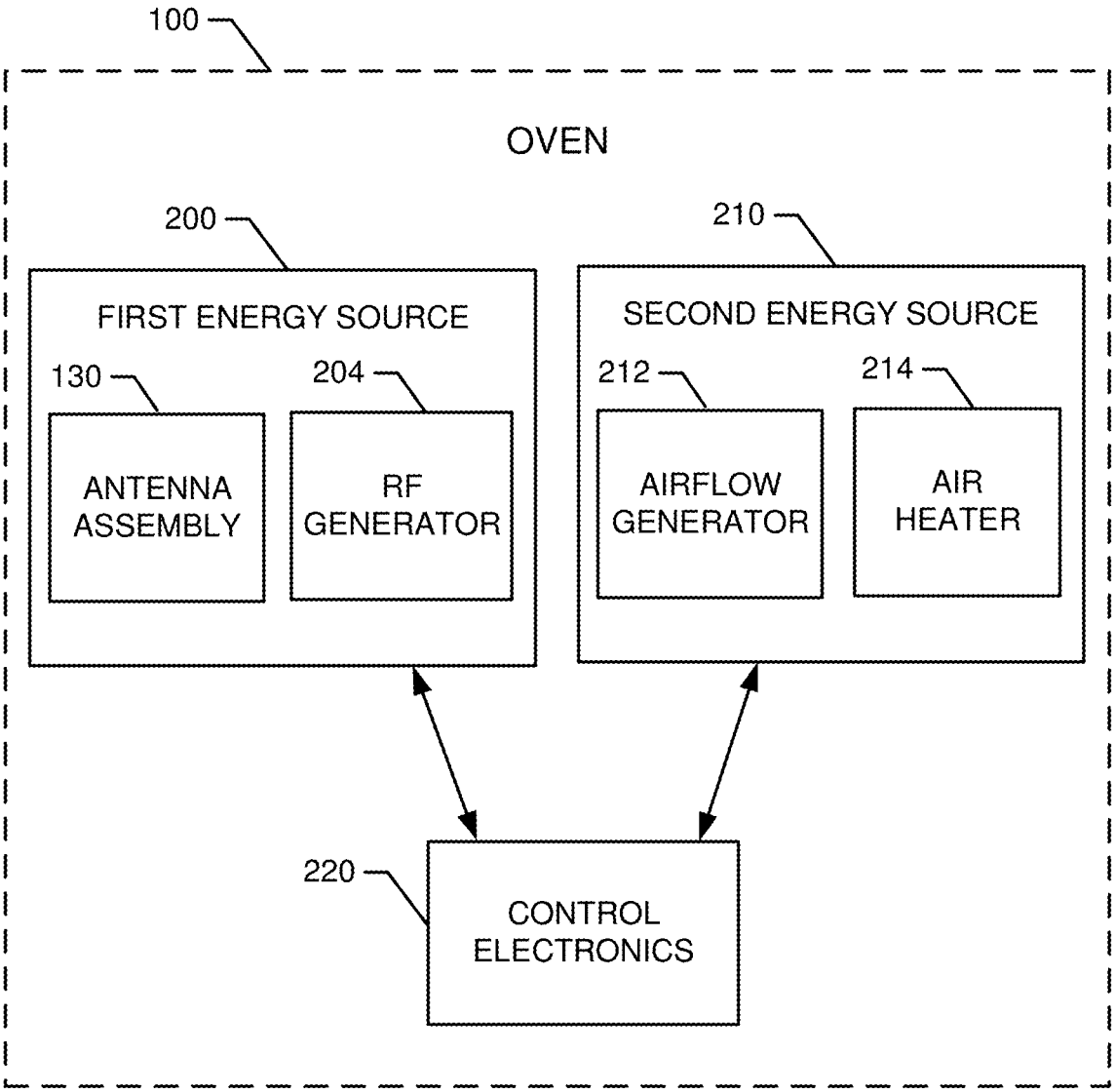
FIG. 2 illustrates a functional block diagram of the oven of FIG. 1 according to an example embodiment.

FIG. 2 illustrates a functional block diagram of the oven 100 according to an example embodiment. As shown in FIG. 2, the oven 100 may include at least a first energy source 200 and a second energy source 210. The first and second energy sources 200 and 210 may each correspond to respective different cooking methods. In some embodiments, the first and second energy sources 200 and 210 may be an RF heating source and a convective heating source, respectively. However, it should be appreciated that additional or alternative energy sources may also be provided in some embodiments. Moreover, some example embodiments could be practiced in the context of an oven that includes only a single energy source (e.g., the second energy source 210). As such, example embodiments could be practiced on otherwise conventional ovens that apply heat using, for example, gas or electric power for heating.

As mentioned above, the first energy source 200 may be an RF energy source (or RF heating source) configured to generate relatively broad spectrum RF energy or a specific narrow band, phase controlled energy source to cook food product placed in the cooking chamber 102 of the oven 100. Thus, for example, the first energy source 200 may include the antenna assembly 130 and an RF generator 204. The RF generator 204 of one example embodiment may be configured to generate RF energy at selected levels and with selected frequencies and phases. In some cases, the frequencies may be selected over a range of about 6 MHz to 246 GHz. However, other RF energy bands may be employed in some cases. In some examples, frequencies may be selected from the ISM bands for application by the RF generator 204.

In some cases, the antenna assembly 130 may be configured to transmit the RF energy into the cooking chamber 102 and receive feedback to indicate absorption levels of respective different frequencies in the food product. The absorption levels may then be used to control the generation of RF energy to provide balanced cooking of the food product. Feedback indicative of absorption levels is not necessarily employed in all embodiments however. For example, some embodiments may employ algorithms for selecting frequency and phase based on pre-determined strategies identified for particular combinations of selected cook times, power levels, food types, recipes and/or the like. In some embodiments, the antenna assembly 130 may include multiple antennas, waveguides, launchers, and RF transparent coverings that provide an interface between the antenna assembly 130 and the cooking chamber 102. Thus, for example, four waveguides may be provided and, in some cases, each waveguide may receive RF energy generated by its own respective power module or power amplifier of the RF generator 204 operating under the control of control electronics 220. In an alternative embodiment, a single multiplexed generator may be employed to deliver different energy into each waveguide or to pairs of waveguides to provide energy into the cooking chamber 102.

In an example embodiment, the second energy source 210 may be an energy source capable of inducing browning and/or convective heating of the food product. Thus, for example, the second energy source 210 may a convection heating system including an airflow generator 212 and an air heater 214. The airflow generator 212 may be embodied as or include the heated-air circulation fan or another device capable of driving airflow through the cooking chamber 102 (e.g., via the air delivery orifices 112). The air heater 214 may be an electrical heating element or other type of heater that heats air to be driven toward the food product by the airflow generator 212. Both the temperature of the air and the speed of airflow will impact cooking times that are achieved using the second energy source 210, and more particularly using the combination of the first and second energy sources 200 and 210.

In an example embodiment, the first and second energy sources 200 and 210 may be controlled, either directly or indirectly, by the control electronics 220. The control electronics 220 may be configured to receive inputs descriptive of the selected recipe, food product and/or cooking conditions in order to provide instructions or controls to the first and second energy sources 200 and 210 to control the cooking process. In some embodiments, the control electronics 220 may be configured to receive static and/or dynamic inputs regarding the food product and/or cooking conditions. Dynamic inputs may include feedback data regarding phase and frequency of the RF energy applied to the cooking chamber 102. In some cases, dynamic inputs may include adjustments made by the operator during the cooking process. The static inputs may include parameters that are input by the operator as initial conditions. For example, the static inputs may include a description of the food type, initial state or temperature, final desired state or temperature, a number and/or size of portions to be cooked, a location of the item to be cooked (e.g., when multiple trays or levels are employed), a selection of a recipe (e.g., defining a series of cooking steps) and/or the like.

In some embodiments, the control electronics 220 may be configured to also provide instructions or controls to the airflow generator 212 and/or the air heater 214 to control airflow through the cooking chamber 102. However, rather than simply relying upon the control of the airflow generator 212 to impact characteristics of airflow in the cooking chamber 102, some example embodiments may further employ the first energy source 200 to also apply energy for cooking the food product so that a balance or management of the amount of energy applied by each of the sources is managed by the control electronics 220.

In an example embodiment, the control electronics 220 may be configured to access algorithms and/or data tables that define RF cooking parameters used to drive the RF generator 204 to generate RF energy at corresponding levels, phases and/or frequencies for corresponding times determined by the algorithms or data tables based on initial condition information descriptive of the food product and/or based on recipes defining sequences of cooking steps. As such, the control electronics 220 may be configured to employ RF cooking as a primary energy source for cooking the food product, while the convective heat application is a secondary energy source for browning and faster cooking. However, other energy sources (e.g., tertiary or other energy sources) may also be employed in the cooking process.

In some cases, cooking signatures, programs or recipes may be provided to define the cooking parameters to be employed for each of multiple potential cooking stages or steps that may be defined for the food product and the control electronics 220 may be configured to access and/or execute the cooking signatures, programs or recipes (all of which may generally be referred to herein as recipes). In some embodiments, the control electronics 220 may be configured to determine which recipe to execute based on inputs provided by the user except to the extent that dynamic inputs (i.e., changes to cooking parameters while a program is already being executed) are provided. In an example embodiment, an input to the control electronics 220 may also include browning instructions. In this regard, for example, the browning instructions may include instructions regarding the air speed, air temperature and/or time of application of a set air speed and temperature combination (e.g., start and stop times for certain speed and heating combinations). The browning instructions may be provided via a user interface accessible to the operator, or may be part of the cooking signatures, programs or recipes.

As discussed above, the first energy source 200 may be an RF energy source configured to generate selected RF frequencies (e.g., in the ISM band) into the cooking chamber 102. The choke 140 may be provided to seal the RF frequencies in the cooking chamber 102 during operation of the oven 100 with the door 104 closed. The choke 140 therefore operates at the interface between the cooking chamber 102 and the door 104. The interface is the relatively large opening into the front of the cooking chamber 102.

The choke 140 is provided to seal RF energy at the interface by providing what is essentially a tuned reflector assembly to keep RF energy in the cooking chamber 102. The choke 140 is constructed based on providing a quarter-wave resonant circuit. More particularly, the choke 140 employs ¼ wavelength (λ) resonant elements that have a width that is substantially uniform around the perimeter of the choke 140. The gasket 142 may extend around the periphery of the ¼ wavelength resonant elements, and be slightly separated therefrom.

Figure 3A:
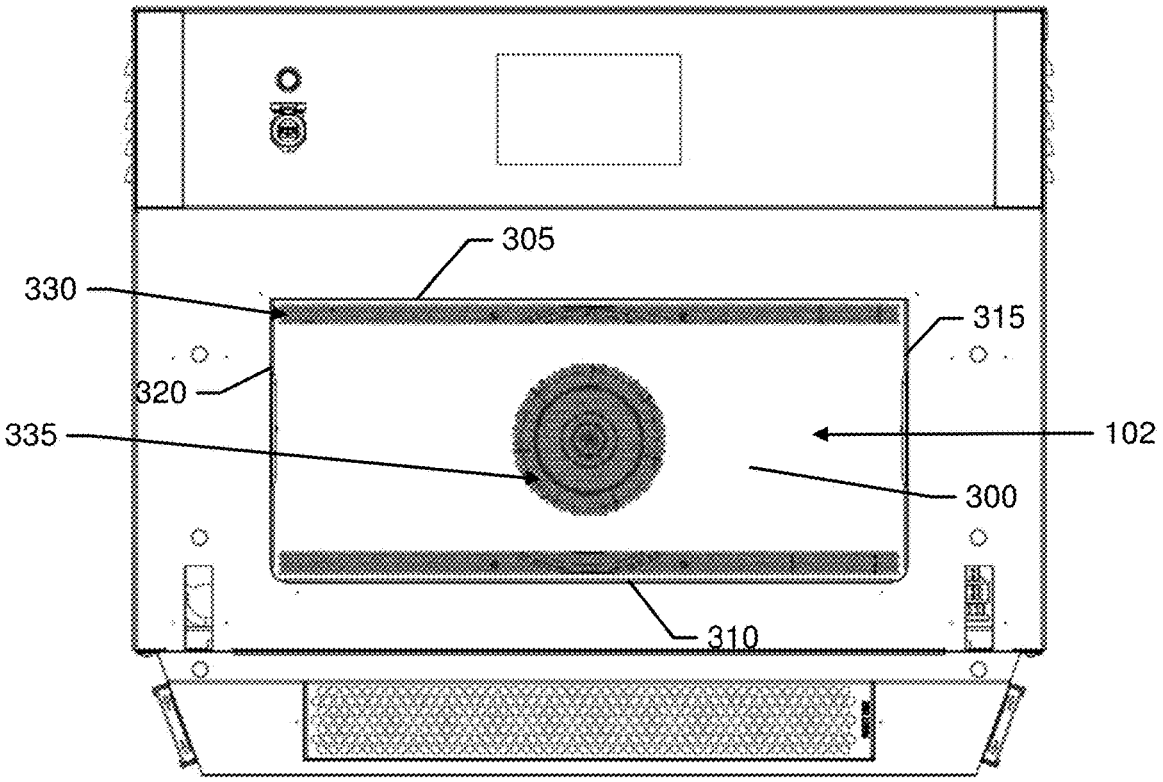
FIG. 3A illustrates a front view of a cooking chamber of the oven with the door removed according to an example embodiment.
Figure 3B:
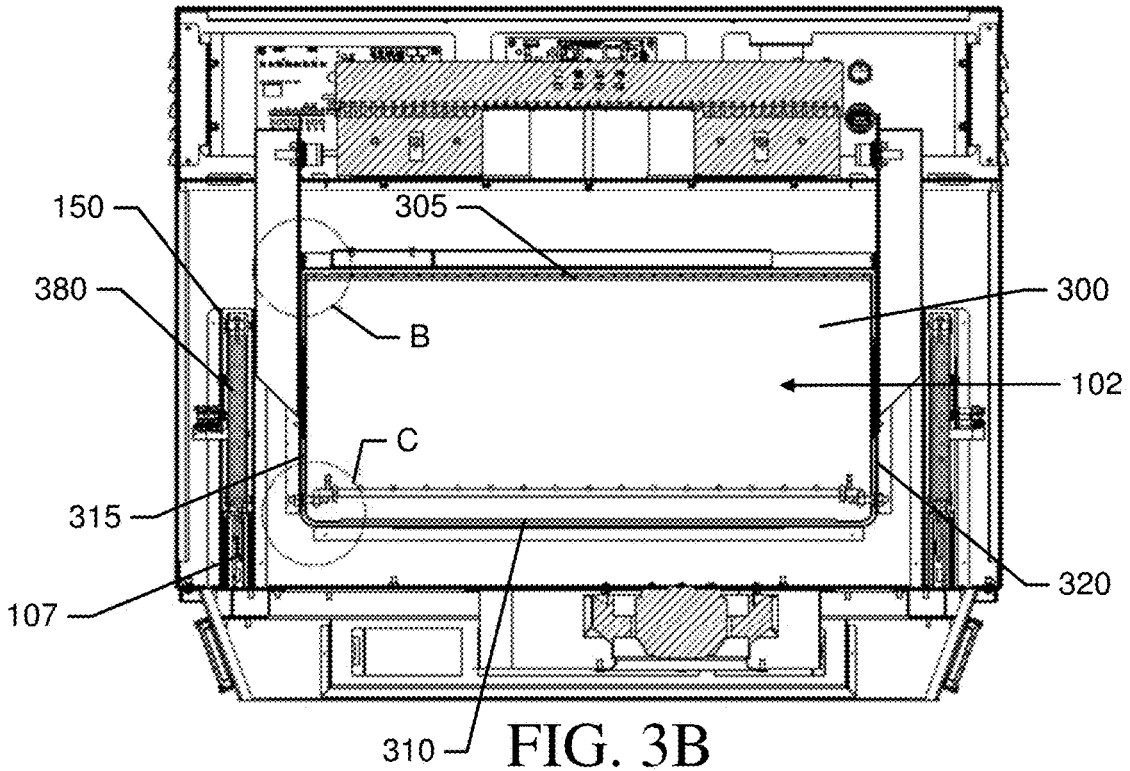
FIG. 3B illustrates a cross section view of the cooking chamber looking forward from a rear perspective according to an example embodiment.
Figure 3C:
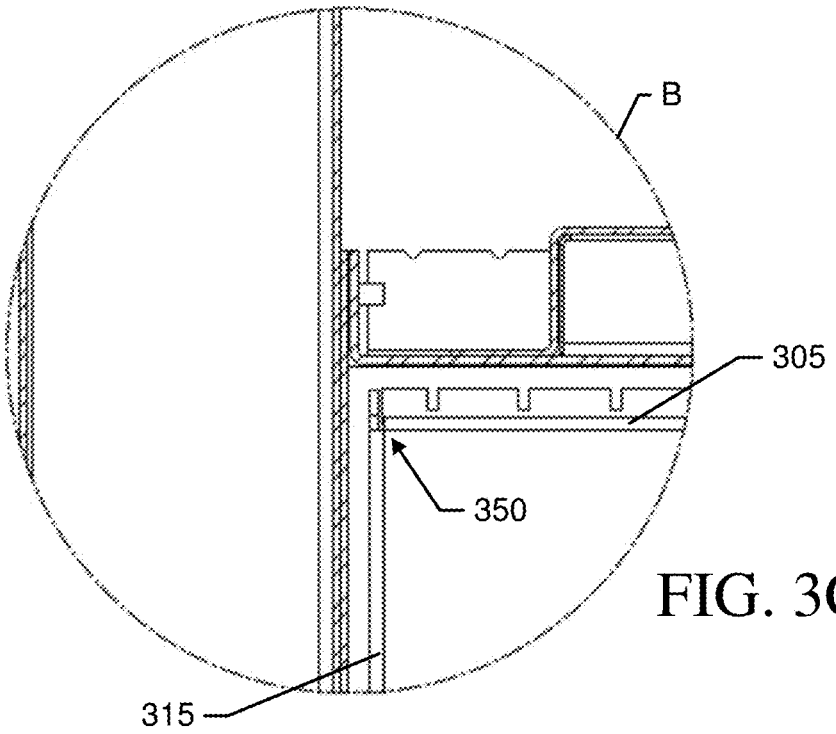
FIG. 3C illustrates a closer view of a top corner portion of the cooking chamber according to an example embodiment.
Figure 3D:
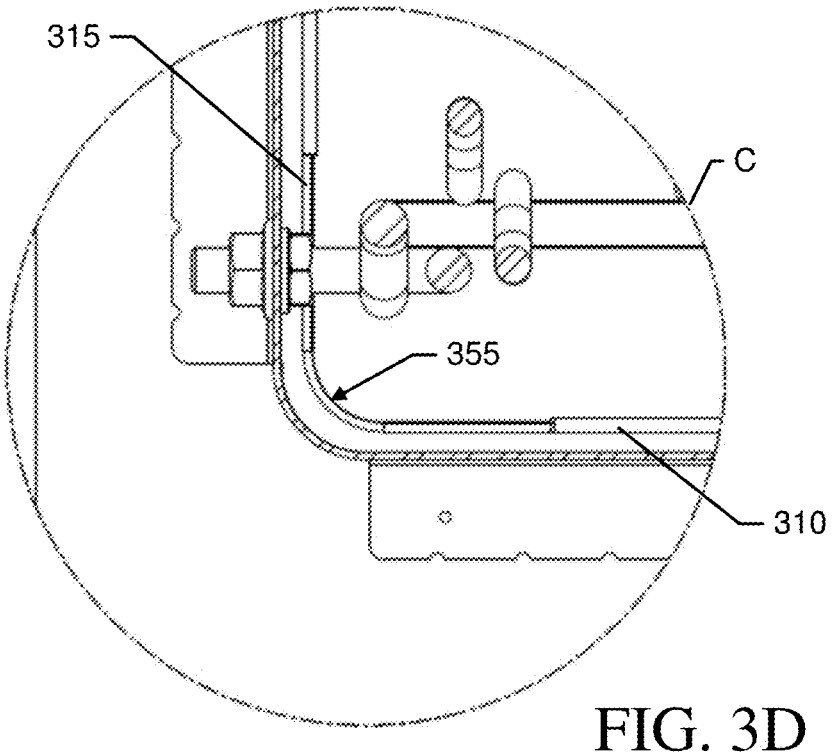
FIG. 3D illustrates a closer view of a bottom corner portion of the cooking chamber according to an example embodiment.

Before the specific structure of the choke 140 is described, the general shape of the cooking chamber 102 and unique aspects of the interface will be discussed to give a greater appreciation for the potential desire for inclusion of the unique structural design aspects mentioned above in reference to FIG. 3, which is defined by FIGS. 3A, 3B, 3C and 3D. In this regard, FIG. 3A illustrates a front view of the cooking chamber 102 with the door 104 removed, and FIG. 3B illustrates a cross section view of the cooking chamber 102 looking forward from a rear perspective. FIG. 3C illustrates a closer view of a top corner portion of the cooking chamber 102, which portion is labeled as circle B in FIG. 3B. FIG. 3D illustrates a closer view of a bottom corner portion of the cooking chamber 102, which portion is labeled as circle C in FIG. 3B.

Referring primarily to FIGS. 3A, 3B, 3C and 3D, the cooking chamber 102 is defined by five fixed walls and the door 104 (shown in FIG. 1, but not in FIG. 3). The five fixed walls include a back wall 300, a top wall 305, a bottom wall, 310, a first sidewall 315 and second sidewall 320. The first and second sidewalls 315 and 320 are opposing sidewalls and could be considered right and left sidewalls, respectively, when the cooking chamber 102 is viewed through the opening formed when the door 104 is opened. The back wall 300 includes inlet air perforations 330 and outlet air perforations 335 through which air passes (and RF energy cannot pass) as part of the first air circulation system. The back wall 300, the top wall 305, the bottom wall, 310, and the first and second sidewalls 315 and 320 are each substantially planar in shape (e.g., forming a substantially rectangular planar surface) and the planar surfaces of each wall terminate at linearly arranged ends that are joined to adjacent walls at respective intersections.

As shown in FIG. 3, the intersection between the top wall 305 and the first sidewall 315 forms a substantially 90 degree intersection. In other words, not only does the top wall 305 extend substantially perpendicular to the first sidewall 315, but the intersection between the top wall 305 and the first sidewall 315 also substantially forms a right angle along its entire length. Similarly, the intersection between the top wall 305 and the second sidewall 320 forms a substantially 90 degree intersection. In other words, not only does the top wall 305 extend substantially perpendicular to the second sidewall 320, but the intersection between the top wall 305 and the second sidewall 320 also substantially forms a right angle along its entire length. The intersection between the top wall 305 and the back wall 300 is also similar.

However, the intersections between the bottom wall 310 and both the first and second sidewalls 315 and 320 (and corresponding corners formed thereby) are different. In this regard, although the bottom wall 310 extends substantially perpendicular to the first sidewall 315, the intersection between the bottom wall 310 and the first sidewall 315 does not form a right angle along its entire length. Instead, the intersection between the bottom wall 310 and the first sidewall 315 is curved along its entire length. Similarly, although the bottom wall 310 extends substantially perpendicular to the second sidewall 320, the intersection between the bottom wall 310 and the second sidewall 320 does not form a right angle along its entire length. Instead, the intersection between the bottom wall 310 and the second sidewall 320 is also curved along its entire length. The curves of the respective interfaces between the bottom wall 310 and both the first and second sidewalls 315 and 320 are substantially symmetrical about a centerline dividing the cooking chamber 102 midway between the respective corners. The intersections between the back wall 300 and each of the first and second sidewalls 315 and 320 and the bottom wall 310 are substantially right angle intersections except at the region where the first and second sidewalls 315 and 320 meet the bottom wall 310.

Referring specifically to FIGS. 3C and 3D, the intersection between the first sidewall 315 and the top wall 305 may form a right angle corner 350. As discussed above, the second sidewall 320 may also meet the top wall 305 at a similarly structured interface to the right angle corner 350 of FIG. 3C. Meanwhile, the intersection between the first sidewall 315 and the bottom wall 310 may form a curved corner 355. The curved corner 355 may provide a surface that is substantially easier to clean than would a right angle corner in this position (i.e., at the bottom of the cooking chamber 102). In this regard, for example, spills or splatter created by the cooking process or after insertion of food product into the cooking chamber 102 can leave materials that would be very difficult (and sometimes impossible) to clean if the curved corner 355 were instead a right angle corner. Furthermore, after a spill or splatter is exposed to high heat, the material may become difficult to remove, further exacerbating the problem described above, and causing a buildup of material over time. By providing the curved corner 355, the surface associated therewith can more easily be cleaned either by the application of cleaning agents, the application of cleaning force, and/or by the use of tools that would otherwise be difficult to apply to a right angle corner. Meanwhile, for corners near the top of the cooking chamber 102, it is far less likely that splatter or spills will reach these surfaces, so a right angle corner (and the simplicity of designing and building the cooking chamber 102). In particular, in an example embodiment, the bottom wall 310 and both the first and second sidewalls 315 and 320 may be made from a single sheet of material (e.g., metal). Thus, the single sheet may be bent to form an instance of the curved corner 355 between the bottom wall 310 and each of the first and second sidewalls 315 and 320. Then, the top wall 310 and the back wall 300, each of which may be individual planar sheets of metal, can be affixed to the single sheet of material forming the bottom wall 310 and both the first and second sidewalls 315 and 320. Moreover, in some cases, the back wall 300 and top wall 305 could be a single sheet bent at a right angle at their intersection. Thus, in some cases, the cooking chamber 102 could be formed from as little as two sheets of material or as many as three sheets of material.

The hinge assembly 107 of FIG. 1 is also visible in FIG. 3B. Moreover, the hinge assembly 107 is further illustrated as being operably coupled to a spring assembly 380 which is connected at one end thereof to the hinge assembly 107, and is connected at the other end to a portion of the oven body 150. As can be seen from FIG. 3B, the spring assembly 380 is operably coupled to the hinge assembly 107 at an elevation near that of the bottom wall 310. Meanwhile, the spring assembly 380 is operably coupled to the oven body 150 at an elevation slightly below the elevation of the top wall 305. Thus, the spring assembly 380 extends longer than half the height of the first and second sidewalls 315 and 320, and in some cases, longer than ¾ the height of the first and second sidewalls 315 and 320. This provides a higher degree of leverage to support the weight of the door 104 during rotation between open and closed positions.

Given that the cooking chamber 102 has a specific shape at the interface with the door 104 (e.g., two rounded bottom corners and two right angle top corners), the choke 140 must also have a corresponding shape. Moreover, the requirement for the door 104 to rotate between open and closed positions while putting the choke 140 in position to function properly in light of the specific shape of the interface places further design limitations on the choke 140 and may influence the most efficient and/or advantageous ways to manufacture the choke 140.

Figure 4B:
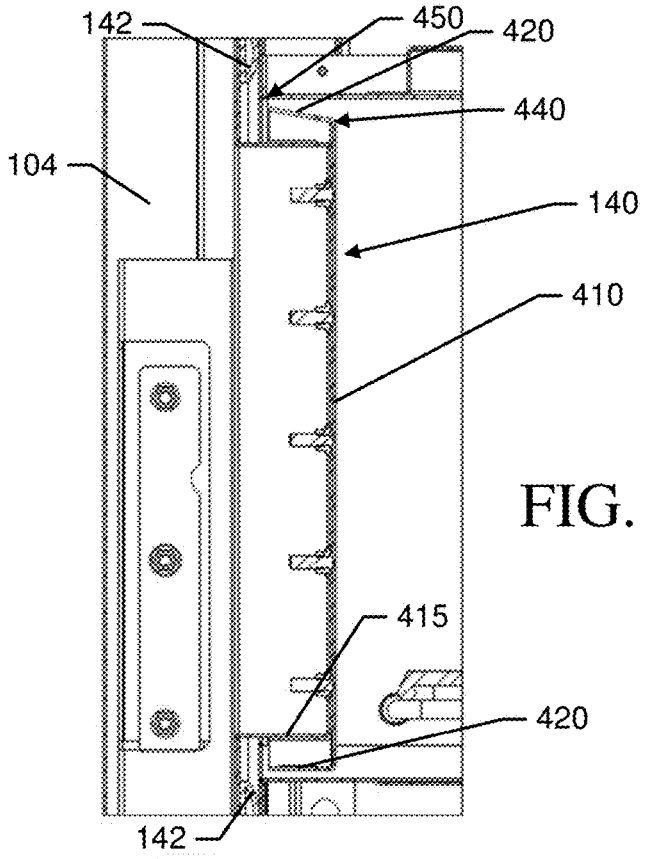
FIG. 4B illustrates a cross sectional side view taken from the same side of the oven to show the door and interface with the RF choke in the closed position according to an example embodiment.
Figure 4A:
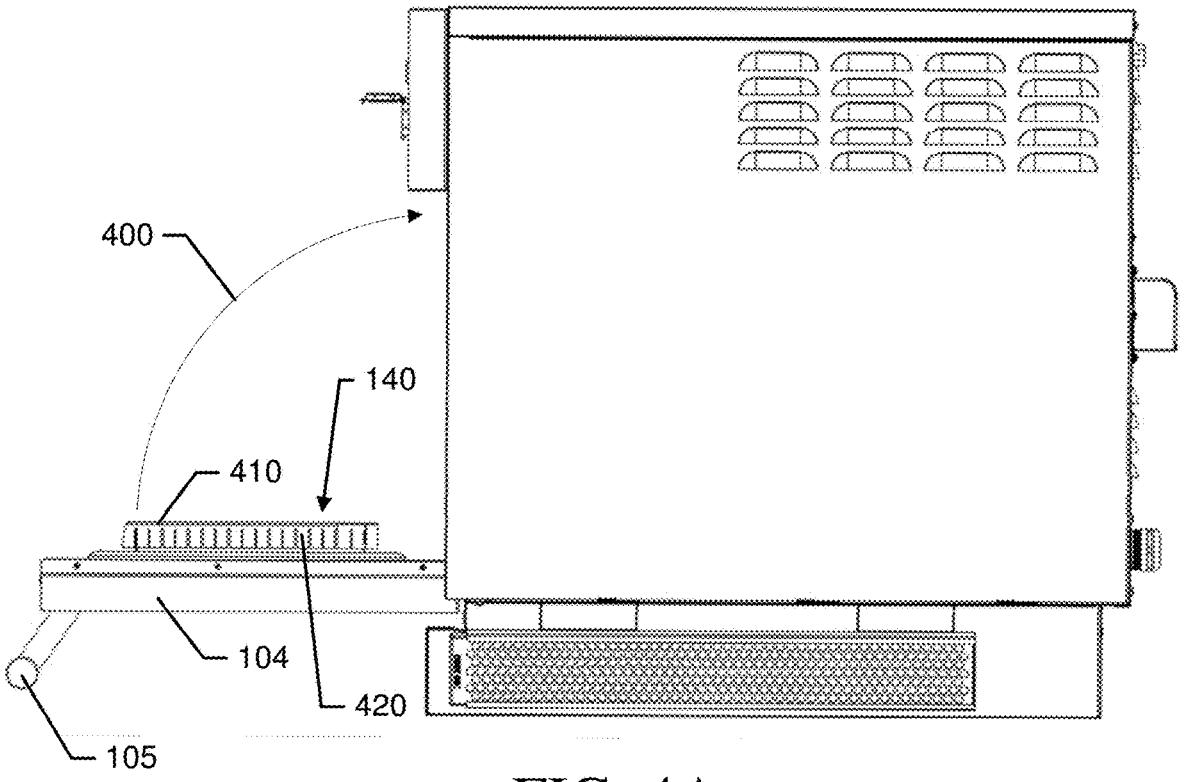
FIG. 4A illustrates a side view of the door in the open position and the RF choke provided on the door according to an example embodiment.

FIG. 4A illustrates a side view of the door 104 in the open position, and FIG. 4B illustrates a cross sectional side view taken from the same side of the oven 100 to show the door 104 in the closed position. As can be appreciated from FIG. 4A, when the handle 105 is lifted, the door 104 may rotate in the direction shown by arrow 400. As the door 104 rotates into contact with the interface with the cooking chamber 102 opening, the choke 140 will need to be inserted into the opening.

Referring to FIGS. 4A and 4B, it can be seen that the choke 140 generally includes a base portion 410 and a plurality of resonant elements 420 that extend way from the base portion 410, and are disposed around the periphery of the base portion 410. The base portion 410 is shaped substantially similarly to the shape of the opening in the cooking chamber 102, and is mounted onto an inside portion of the door 104 with a mounting structure 415. The mounting structure 415 extends in an inward direction when the door 104 is in the closed position or in an upward direction when the door 104 is in the open position. The base portion 410 may be formed of sheet metal having a thickness sufficient to give the base portion 410 a strength and durability. In this regard, pans or containers may routinely be set on (or fall on) the base portion 410 when the door 104 is in the open position. Thus, the thickness of the base portion 410 should be sufficient to handle impact and avoid any puncture damage or excessive denting or damage to the base portion 410. In some examples, the thickness of the base portion 410 may be between about 1 mm and 1.5 mm (e.g., 1.2 mm).

As can be seen from FIG. 4B, the base portion 410 may be inserted fully into the cooking chamber 102 when the door 104 is in the closed position. Meanwhile, the resonant elements 420 extend back toward the door 104 and terminate at a point substantially in (or near) a plane with the opening of the cooking chamber 102. In other words, a plane connecting forward ends of the top wall 305, bottom wall 310 and the first and second sidewalls 315 and 320 may interest the distal ends of the resonant elements 420. The resonant elements 420 may extend around all peripheral edges of the base portion 410 back toward the door 104 such that the base portion 410 ends up being inserted into the cooking chamber 100 by a distance substantially equal to the length of the resonant elements 420.

As may be appreciated from FIG. 4B, rotation of the door 104 from the open position of FIG. 4A in the direction of arrow 400 (also shown in FIG. 4A) could cause a top portion 440 of the choke 140 to strike or impact the top edge 450 of the cooking chamber 102. Accordingly, in order to ensure that the top portion 440 of the choke 140 does not contact the top edge 450 of the cooking chamber 102 during closing of the door 104, the resonant elements 420 along the top of the choke 140 (the term "top" referring to a position when the door 104 is closed) are tapered downward as they progress inwardly (again in reference to when the door 104 is closed). In other words, the base portion 410 is substantially equidistant from the first and second sidewalls 315 and 320 and the bottom wall 310. However, the base portion 410 is spaced apart farther from the top wall 305 than from the first and second sidewalls 315 and 320 and the bottom wall 310. Moreover, the resonant elements 420 are substantially perpendicular to the base portion 410 at portions of the choke 140 that are proximate to the first and second sidewalls 315 and 320 and the bottom wall 310. Thus, the resonant elements 420 are substantially parallel to the respective ones of the first and second sidewalls 315 and 320 and the bottom wall 310. However, the resonant elements 420 form an angle relative to top wall 305 and are not either perpendicular to the base portion 410 or parallel to the top wall 305. Moreover, due to the shape of the interface at the opening of the cooking chamber 102, the choke 140 will be required to have two rounded corners and two substantially right angle corners. Thus, the relationships described above may be slightly different in areas where the rounded corners exist.

Figure 5A:
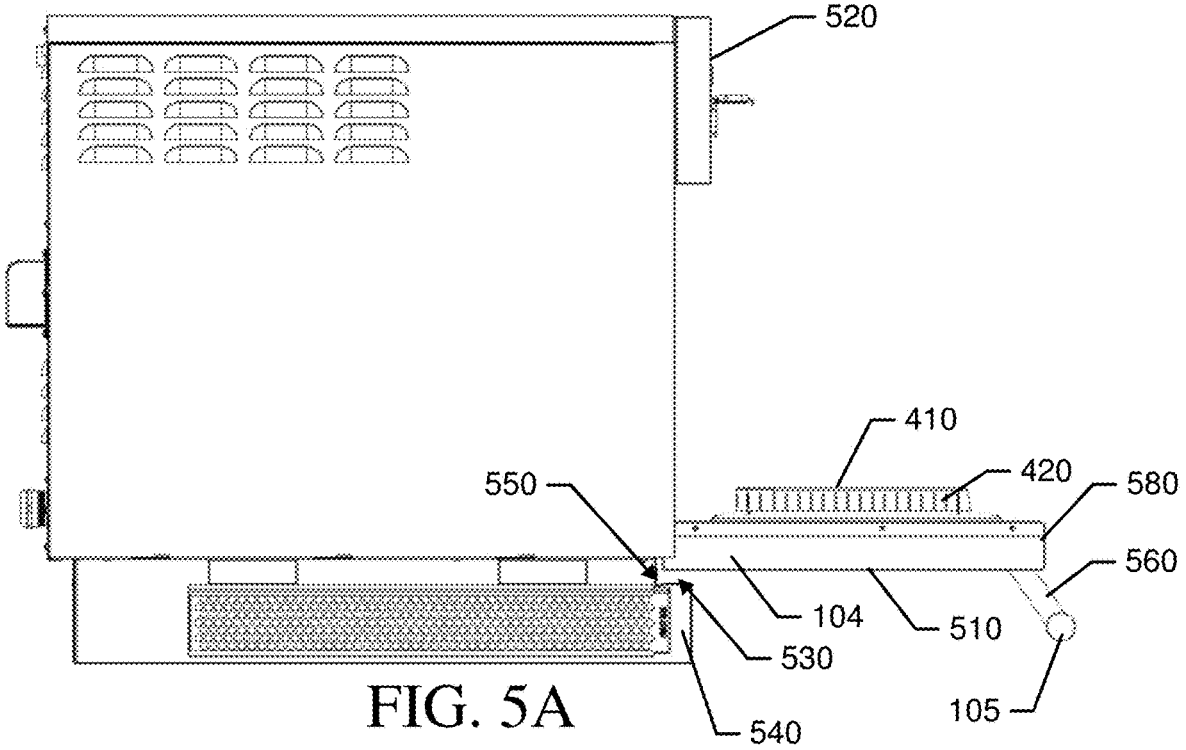
FIG. 5A illustrates a right side view of a door assembly of the oven in accordance with an example embodiment.
Figure 5B:
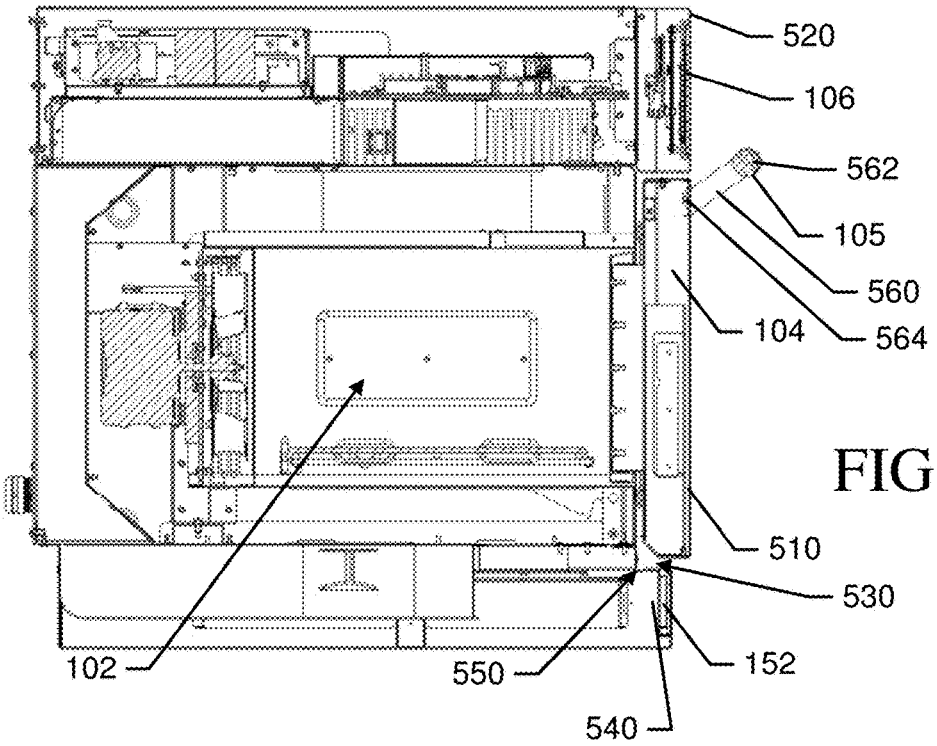
FIG. 5B illustrates a cross sectional right side view of the door assembly according to an example embodiment.
Figure 5C:
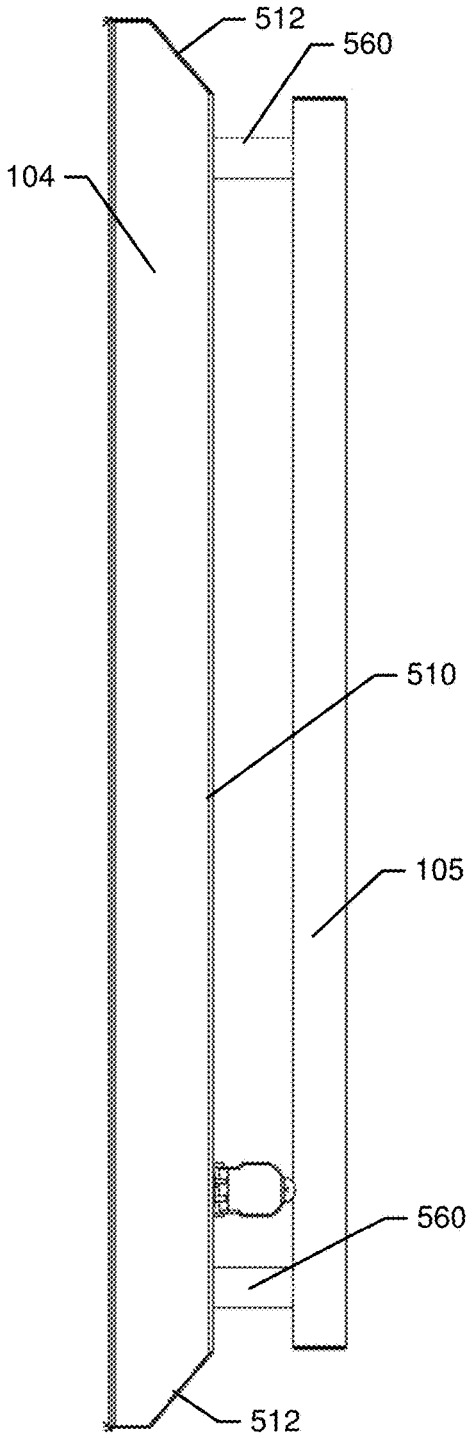
FIG. 5C illustrates a top view of the door according to an example embodiment.
Figure 5D:
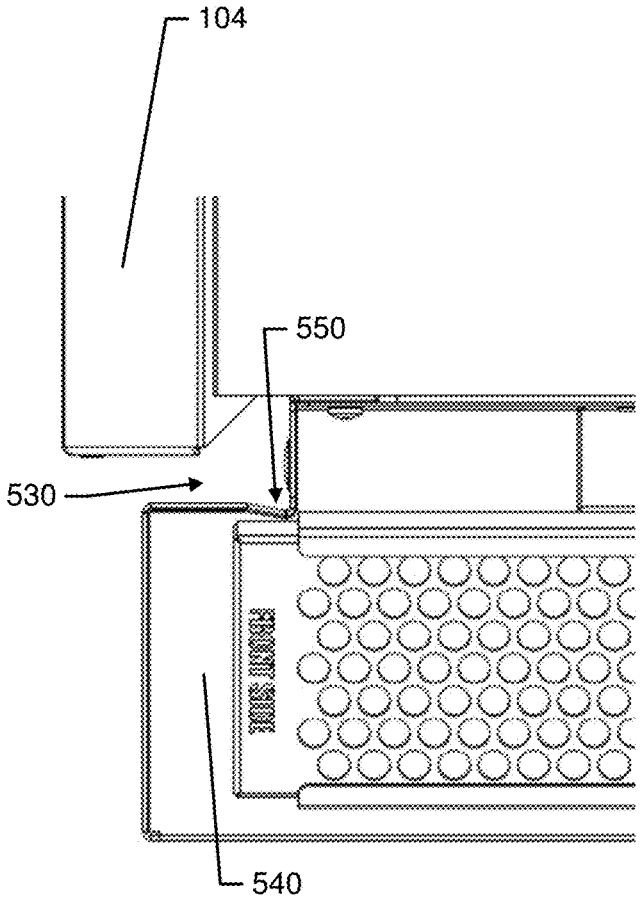
FIG. 5D illustrates a side view of an extension portion that is proximate to a bottom of the door according to an example embodiment.

FIG. 5A illustrates a right side view of the oven 100 with the door 104 open, and FIG. 5B illustrates a cross section view of the oven 100 with the door 104 closed to further facilitate discussion of various aspects of the door 104. FIG. 5C illustrates a top view of the door 104, and FIG. 5D illustrates a side view of a portion of the basement (e.g., an extension portion) that is proximate to a bottom of the door 104. Referring to FIGS. 5A, 5B and 5C, the handle 105 is shown extending away from the door 104 at an angle relative to a front surface of the door 104. In particular, handle supports 500 extend at an angle of about 45 degrees (relative to a plane defining the front surface of the door 104) between the door 104 and the handle 105. The door 104 be defined by one or more frame members, and may have one or more body panels disposed about the frame members. Front body panels may be made of stainless steel, or any other metal with or without a suitable finishing material provided thereon for aesthetic purposes.

In an example embodiment, the front body panels may include a front face 510, and two tapered side faces 512 that extend out of the plane of the front face 510 backward toward the rear edges of the door 104. In an example embodiment, the tapered side faces 512 may extend rearward at about a 45 degree angle relative to the front face 510. The front face 510 and each of the side faces 512 are substantially planar in this example. However, in some cases, portions of or the entire front face (or portions thereof) may be curved, bowed or have embossing or indentations for aesthetic reasons.

In this example, the front face 510 forms a plane that lies substantially parallel to a plane formed by the inside of the door 104, and a plane formed by the base portion 410 of the choke 140. The plane formed by the inside of the door 104 is substantially parallel to a plane in which the opening of the cooking chamber 102 lies at the interface between the door 104 and the cooking chamber 102 (e.g., a plane of the interface between the door 104 and the cooking chamber 102), when the door 104 is in the closed position. A plane of the door 104 may therefore be a plane that is substantially parallel to any of these aforementioned planes. In some cases, when the door 104 is in the closed position, the plane of the front face 510 may lie substantially parallel to (and in some cases also in the same plane as) a front panel 520 proximate to the attic region, and on which the interface panel 106 is formed. Thus, when the door 104 is in the closed position, the front face 510 and the front of the front panel 520 may form a nearly continuous surface for aesthetic purposes. The front panel 520 may also have tapered sides to match the side faces 512 of the door 104 (see FIG. 1). However, the basement portion of the oven may be receded backward relative to the front face 510. In this regard, the forward facing filter of the inlet array 152 may lie substantially parallel to the plane of the door 104, but rearward of the plane of the door 104.

When the door 104 rotates from the closed position (FIG. 5B) to the open position (FIG. 5A), the bottom portion of the door 104 rotates about the pivot axis formed by the hinge assembly 107 to pass through the plane of the interface between the door 104 and the cooking chamber 102 (as shown in FIG. 5A). The bottom portion of the door 104 pivots through a receiving space 530 formed between the bottom portion of the door 104 and an extension portion 540 of the basement. The extension portion 540 extends at least partially under the door so that the front filter of the inlet array 152 is located beneath the door 104, but forward of the plane formed by the inside of the door 104. This positioning ensures that, while the door 104 pivots between the open and closed positions, any liquid or other material on the inside of the door 104 cannot roll or run down the door and foul the front filter of the inlet array 152. Moreover, a cleaning slot 550 may be formed on a top surface of the extension portion 540 to collect or catch any runoff liquid or other materials that are deposited from the door 104, as described above, or by other means. The cleaning slot 550 may be a portion of the extension portion 540 that is slightly angled downward and backward to create a trench or depression extending substantially parallel to the front of the oven 100. A cloth or other cleaning implement may be passed through the cleaning slot 550 to clear or absorb debris and/or liquids collected therein. Meanwhile, such debris or liquids will not foul the front filter or generally discolor or dirty the basement of the oven 100.

As shown in FIG. 5C, the handle 105 may be supported relative to the door 104 by handle supports 560. The handle supports 560 may be round, oval, rectangular, or have any other suitable cross section shape. The handle supports 560 may be anchored or otherwise affixed to the door 104 at a proximal end thereof, and may be anchored or otherwise affixed to the handle 105 at a distal end thereof. As shown in FIG. 5B, the handle 105 may be a substantially hollow steel tubular member. Although circular in cross section in this example, other shapes may also be used. Regardless of the shape, a bolt 562 or other fastener may be passed through a portion of the handle 105 and into the handle support 560 to secure the handle support 560 to the handle 105. If such a fastener is employed, the fastener will generally be inserted into the distal end of the handle support 560 in a direction that is substantially parallel to the longitudinal direction of extension of the handle support 560. Moreover, in some cases, the fastener may be extended to be coaxial with the handle support 560 to provide a secure fit. Meanwhile, when the handle support 560 is attached at its proximal end to the front face 510 of the door 104 at a portion of the front face 510 that is coplanar with other portions of the front face 510, a bolt 564 or other fastener used to attach the door 104 to the handle support 560 may not be inserted coaxial with, or even parallel to the longitudinal direction of extension of the handle support 560, as shown in FIG. 5B. However, there are various options for attaching the handle support 560, some of which are more clearly described below in reference to FIGS. 6A, 6B and 6C. Regardless of the specific option, some example embodiments provide that the handle 105 ends up extending beyond (e.g., above in the closed position) a top portion 580 of the door 104 along a direction extending from a pivot axis of the door 104 (or bottom of the door 104) toward the top portion 580 of the door 104. Thus, for example, in the closed position of the door 104, the handle 105 is at a higher elevation than the top portion 580 of the door 104. Moreover, in some cases, the handle 105 may be positioned entirely above the elevation of the top portion 580 of the door 104 (e.g., at or above the elevation of the front panel 520).

Accordingly, when the door 104 is grasped by the operator and pivoted from the open position to the closed position, the handle 105 can be seen and grasped by the user throughout the entire operation. Thus, the user never needs to release the handle 105, or lose sight of the handle 105 while the door 104 is being opened. Conversely, when the user wishes to take the door 104 from the open position to the closed position, the handle 105 is visible to the user and can be grasped directly (i.e., without the user blindly reaching beneath the door 104). The user can then employ either an overhand or an underhand grip to grasp the handle 105 in the open position and pivot the door 104 to the closed position.

Figure 6C:
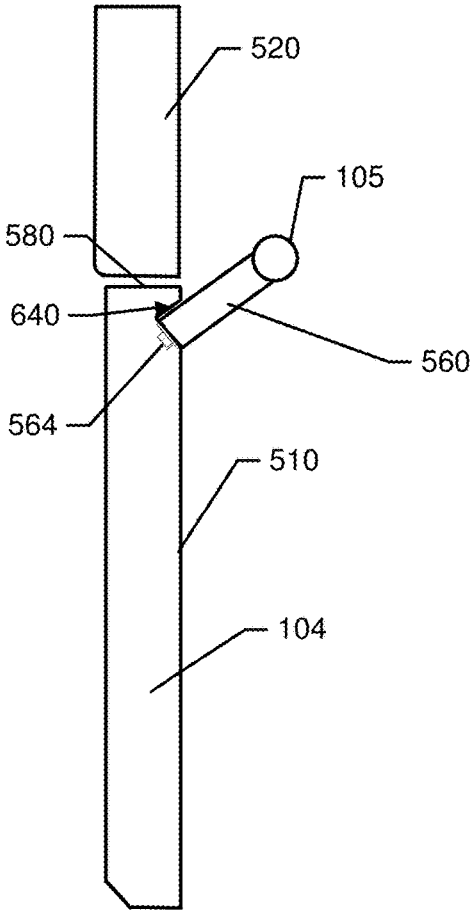
FIG. 6C illustrates a third structure for attaching the handle to the door in accordance with an example embodiment.
Figure 6A:
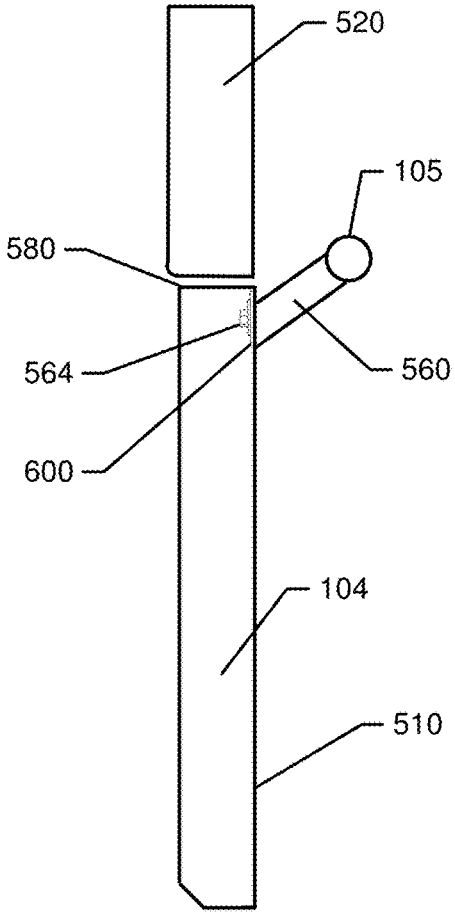
FIG. 6A illustrates a first structure for attaching the handle to the door in accordance with an example embodiment.

FIG. 6A shows an example similar to that of FIG. 5B in greater detail. In this regard, as shown in FIG. 6A, the distal end the handle support 560 is operably coupled to the handle 105 as described above (e.g., via a fastener (e.g., bolt)) that extends into the distal end substantially parallel to a longitudinal direction of extension of the handle support 560). A proximal end of the handle support 560 may form a mating surface that is made to be angled relative to a direction of longitudinal extension of a respective one of the handle supports and/or to the front face 510. The angle may be substantially as the same as the angle at which the handle support 560 extends away from the surface of the front face 510 (e.g., 45 degrees, or between 30 and 60 degrees). More particularly, the angle at which the handle support 560 extends away from the surface of the front face 510 may be complementary to the angle formed by the proximal end (e.g., the circular or oval shaped surface that engages the front face 510) of the handle support 560 relative to the longitudinal direction of extension of the handle support 560. In some embodiments, the proximal end may be operably coupled to the front face of the door via a fastener such as bolt 564. The bolt 564 extends between the front face 510 and the proximal end of the handle support 560 at an angle that is substantially perpendicular to the front face 510 of the door 104. Thus, the bolt 564 and the bolt 562 (see FIG. 5B) are neither parallel to each other nor coaxial. This arrangement may put additional stress on the front face 510 in some cases. Accordingly, in addition to using a washer in connection with application of the bolt 564, a support or reinforcing bar 600 may be provided as a backing to the front face 510 in the region at which the front face 510 interfaces with the handle support 560.

Figure 6B:
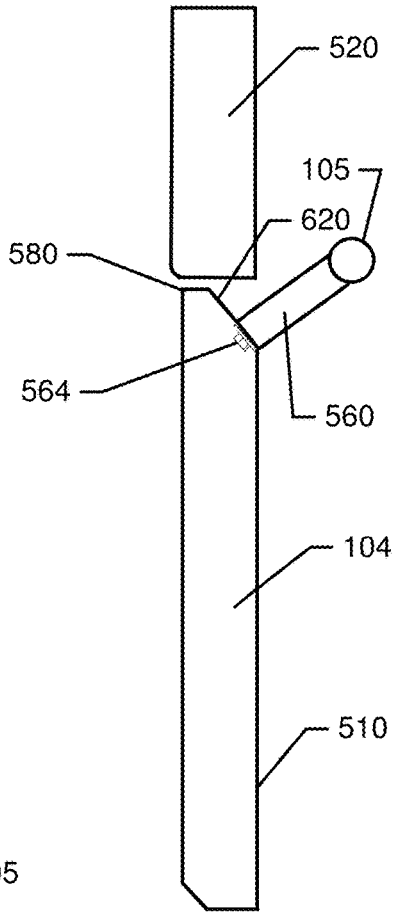
FIG. 6B illustrates a second structure for attaching the handle to the door in accordance with an example embodiment.

In some cases, it may be desirable for the bolt 564 and the bolt 562 to be parallel to each other, or even coaxial with one another. Accordingly, as another potential alternative, a proximal end of the handle support 560 may form a mating surface that lies substantially perpendicular to a direction of longitudinal extension of the handle support 560, as shown in both FIG. 6B and FIG. 6C. In the examples of FIGS. 6B and 6C, the proximal end of the handle support 560 is operably coupled to the door 104 via a fastener (e.g., bolt 564) that extends between the door 104 and the proximal end substantially parallel to the direction of longitudinal extension of the handle support 560. Moreover, in each case, the bolt 564 may be coaxial with the bolt 562 (see FIG. 5B) at the other end of the handle support 560. However, the difference between the examples of FIGS. 6B and 6C are related to the way the door 104 is structured at the interface with the handle support 560. In this regard, the example of FIG. 6B shows a case where the front face 510 has an angled face 620 that extends from the front face 510 to the top portion 580 of the door 104 at the complementary angle to the angle formed between the handle support 560 and the front face 510. The angled face 620 may be similar to the tapered side faces 512 of FIG. 5C. By providing the mating surface that engages the door 104 to be circular and perpendicular to the surface of the angled face 620, less torque may be applied to the door 104 during opening and closing operations, and the weight and cost of adding the reinforcing bar 600 may be avoided. To provide still more support for the handle support 560, the proximal end may actually be at least partially inset into the front face 510 of the door 104. Thus, for example, a circular shaped reception orifice 640 may be formed in the front face 510 and extend into the door 104 at an angle (e.g., matching the angle between the handle support 560 and the front face 510). The reception orifice 640 may therefore form a shaft inside which the handle support 560 can be inserted to permit attachment similar to the manner described in connection with the example of FIG. 6B. However, the top portion of the shaft formed by the reception orifice 640 can provide reinforcing strength to the handle support 560.

By employing the hollow tube as the handle 105, and by employing strategies that allow the handle supports 560 to be operably coupled to the door 104 without significant reinforcing materials, the cost and weight of the door 104 may be reduced. Accordingly, the hinge assembly 107 and spring assembly 380 may be less costly and heavy also. Slamming open of the door 104 may thus be avoided and the oven 100 may be expected to last longer and perform better over its useful lifetime.

In an example embodiment, an oven is provided. The oven may include a door movable between an open position and a closed position, a cooking chamber configured to receive a food product, an RF energy source and an RF choke. The cooking chamber may be defined at least in part by a top wall, a bottom wall, a first sidewall and a second sidewall, and may define an opening that interfaces with the door. The RF energy source may be configured to apply RF energy to the food product. The RF choke may be disposed at a portion of the door facing the cooking chamber when the door is in the closed position. The door may include a handle disposed on a side of the door opposite the RF choke. The handle may be attached to a front face of the door at an angle relative to the front face of the door such that the handle extends beyond a top of the door along a direction extending from a pivot axis of the door toward the top of the door.

In some embodiments, additional optional features may be included or the features described above may be modified or augmented. Each of the additional features, modification or augmentations may be practiced in combination with the features above and/or in combination with each other. Thus, some, all or none of the additional features, modification or augmentations may be utilized in some embodiments. For example, in some cases, the angle may be about 45 degrees (e.g., between 30 degrees and 60 degrees). In some cases, the handle may be embodied as a substantially hollow tube. In an example embodiment, the handle may be operably coupled to the door via handle supports that extend between the front face of the door and the handle at the angle. In an example embodiment, a distal end of each of the handle supports is operably coupled to the handle via a fastener that extends into the distal end substantially parallel to a direction of extension of a respective one of the handle supports. Additionally or alternatively, a proximal end of each of the handle supports may be angled relative to a direction of longitudinal extension of a respective one of the handle supports. In such an example, the proximal end may be operably coupled to the front face of the door via a fastener (e.g., a bolt) that extends between the front face and the proximal end substantially perpendicular to the front face of the door. As another potential alternative or addition, a proximal end of each of the handle supports may be substantially perpendicular to a direction of longitudinal extension of a respective one of the handle supports. In such an example, the proximal end may be operably coupled to the door via a fastener (e.g., a bolt) that extends between the door and the proximal end substantially parallel to the direction of longitudinal extension of the respective one of the handle supports. In some examples, the proximal end of each of the handle supports may engage an angled face extending between the top of the door and the front face angled relative to both the top of the door and the front face. In some cases, the proximal end of each of the handle supports may be inserted into a reception orifice formed in the front face. In an example embodiment, the oven may further include a hinge assembly operably coupling the door to a body of the oven. In such an example, the door maybe configured to pivot about a horizontally oriented axis. An extension portion may be provided to extend below a bottom portion of the door to define a receiving space through which the bottom portion of the door pivots during transition of the door between the open position and the closed position. In an example embodiment, a cleaning slot may be formed in a top surface of the extension portion.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. An oven comprising:

a door movable between an open position and a closed position;

a cooking chamber configured to receive a food product, the cooking chamber being defined at least in part by a top wall, a bottom wall, a first sidewall and a second sidewall, the cooking chamber further defining an opening that interfaces with the door;

a radio frequency (RF) energy source configured to apply RF energy to the food product; and an RF choke disposed at a portion of the door facing the cooking chamber when the door is in the closed position, wherein the door comprises a handle disposed on a side of the door opposite the RF choke, wherein the handle is attached to a front face of the door at an angle relative to the front face of the door such that the handle extends beyond a top of the door along a direction extending from a pivot axis of the door toward the top of the door, wherein the oven further comprises a hinge assembly operably coupling the door to a body of the oven, wherein the door is configured to pivot from the open position to the closed position about a horizontally oriented axis, wherein an extension portion of the oven extends below a bottom portion of the door defining a receiving space through which the bottom portion of the door pivots during transition of the door between the open position and the closed position, and wherein a cleaning slot comprising a depression angled downward and rearward and extending substantially parallel to the front face of the door is formed in the extension portion, the cleaning slot being configured to collect or catch runoff liquid or materials from the door in response to the door pivoting between the open position and the closed position.

2. The oven of claim 1, wherein the angle is about 45 degrees.

3. The oven of claim 1, wherein the handle comprises a substantially hollow tube.

4. The oven of claim 1, wherein the handle is operably coupled to the door via handle supports, the handle supports extending between the front face of the door and the handle at the angle.

5. The oven of claim 4, wherein a distal end of each of the handle supports is operably coupled to the handle via a fastener that extends into the distal end substantially parallel to a direction of extension of a respective one of the handle supports.

6. The oven of claim 4, wherein a proximal end of each of the handle supports is angled relative to a direction of longitudinal extension of a respective one of the handle supports, and wherein the proximal end is operably coupled to the front face of the door via a fastener that extends between the front face and the proximal end substantially perpendicular to the front face of the door.

7. The oven of claim 4, wherein a proximal end of each of the handle supports is substantially perpendicular to a direction of longitudinal extension of a respective one of the handle supports, and wherein the proximal end is operably coupled to the door via a fastener that extends between the door and the proximal end substantially parallel to the direction of longitudinal extension of the respective one of the handle supports.

8. The oven of claim 7, wherein the proximal end of each of the handle supports engages an angled face extending between the top of the door and the front face angled relative to both the top of the door and the front face.

9. The oven of claim 7, wherein the proximal end of each of the handle supports is inserted into a reception orifice formed in the front face.

10. A door assembly for an oven, the door assembly comprising:

a door movable between an open position and a closed position to interface with an opening defined in a cooking chamber of the oven, the cooking chamber being defined at least in part by a top wall, a bottom wall, a first sidewall and a second sidewall;

a radio frequency (RF) choke being disposed at a portion of the door facing the cooking chamber when the door is in the closed position; and a handle disposed on a side of the door opposite the RF choke, wherein the handle is attached to a front face of the door at an angle relative to the front face of the door such that the handle extends beyond a top of the door along a direction extending from a pivot axis of the door toward the top of the door, wherein the door is configured to connect to a body of the oven via a hinge assembly, wherein the door is configured to pivot from the open position to the closed position relative to the body about a horizontally oriented axis, wherein a bottom portion of the door is configured to pivot through a receiving space defined by an extension portion of the oven extending below a bottom portion of the door during transition of the door between the open position and the closed position, wherein in response to the door pivoting between the open position and closed position, runoff liquid or materials from the door is configured to be collected or caught by a cleaning slot formed in the extension portion, wherein the cleaning slot comprises a depression angled downward and rearward and extending substantially parallel to the front face of the door.

11. The door assembly of claim 10, wherein the angle is about 45 degrees.

12. The door assembly of claim 10, wherein the handle comprises a substantially hollow tube.

13. The door assembly of claim 10, wherein the handle is operably coupled to the door via handle supports, the handle supports extending between the front face of the door and the handle at the angle.

14. The door assembly of claim 13, wherein a distal end of each of the handle supports is operably coupled to the handle via a fastener that extends into the distal end substantially parallel to a direction of extension of a respective one of the handle supports.

15. The door assembly of claim 13, wherein a proximal end of each of the handle supports is angled relative to a direction of longitudinal extension of a respective one of the handle supports, and wherein the proximal end is operably coupled to the front face of the door via a fastener that extends between the front face and the proximal end substantially perpendicular to the front face of the door.

16. The door assembly of claim 13, wherein a proximal end of each of the handle supports is substantially perpendicular to a direction of longitudinal extension of a respective one of the handle supports, and wherein the proximal end is operably coupled to the door via a fastener that extends between the door and the proximal end substantially parallel to the direction of longitudinal extension of the respective one of the handle supports.

17. The door assembly of claim 16, wherein the proximal end of each of the handle supports engages an angled face extending between the top of the door and the front face angled relative to both the top of the door and the front face.

18. The door assembly of claim 16, wherein the proximal end of each of the handle supports is inserted into a reception orifice formed in the front face.

19. An oven comprising:

a door movable between an open position and a closed position;

a cooking chamber configured to receive a food product, the cooking chamber being defined at least in part by a top wall, a bottom wall, a first sidewall and a second sidewall, the cooking chamber further defining an opening that interfaces with the door;

a radio frequency (RF) energy source configured to apply RF energy to the food product; and an RF choke disposed at a portion of the door facing the cooking chamber when the door is in the closed position, wherein the door comprises a handle disposed on a side of the door opposite the RF choke, wherein the handle is attached to a front face of the door via handle supports at an angle relative to the front face of the door such that the handle extends beyond a top of the door along a direction extending from a pivot axis of the door toward the top of the door, wherein a proximal end of a handle support is at least partially inset into or coupled directly to the front face of the door, and wherein a cleaning slot comprising a depression angled downward and rearward and extending substantially parallel to the front face of the door is formed in an extension portion of the oven extending below a bottom portion of the door during transition of the door between the open position and the closed position.

* * * * *